US010243268B2

(12) United States Patent
Hasch

(10) Patent No.: US 10,243,268 B2
(45) Date of Patent: Mar. 26, 2019

(54) ANTENNA DEVICE HAVING A SETTABLE DIRECTIONAL CHARACTERISTIC AND METHOD FOR OPERATING AN ANTENNA DEVICE

(71) Applicant: Robert Bosch GmbH, Stuttgart (DE)

(72) Inventor: Juergen Hasch, Stuttgart (DE)

(73) Assignee: ROBERT BOSCH GMBH, Stuttgart (DE)

( * ) Notice: Subject to any disclaimer, the term of this patent is extended or adjusted under 35 U.S.C. 154(b) by 144 days.

(21) Appl. No.: 15/319,926

(22) PCT Filed: Apr. 24, 2015

(86) PCT No.: PCT/EP2015/058884
§ 371 (c)(1),
(2) Date: Dec. 19, 2016

(87) PCT Pub. No.: WO2015/197228
PCT Pub. Date: Dec. 30, 2015

(65) Prior Publication Data

US 2017/0133757 A1 May 11, 2017

(30) Foreign Application Priority Data

Jun. 27, 2014 (DE) ..... 10 2014 212 494

(51) Int. Cl.
*H01Q 3/26* (2006.01)
*H01Q 1/32* (2006.01)
(Continued)

(52) U.S. Cl.
CPC ..... *H01Q 3/26* (2013.01); *H01Q 1/3233* (2013.01); *H01Q 3/2682* (2013.01); *H01Q 21/0006* (2013.01); *H01Q 21/065* (2013.01)

(58) Field of Classification Search
CPC .. H01Q 1/2682; H01Q 1/3233; H01Q 21/065; H01Q 3/26
See application file for complete search history.

(56) References Cited

U.S. PATENT DOCUMENTS 3,293,647 A * 12/1966 Crumpen ..... H01Q 21/005 343/768
4,746,923 A 5/1988 Schwartz et al.
(Continued)

FOREIGN PATENT DOCUMENTS

DE 102010040793 A1 3/2012
DE 102012210314 A1 12/2013
(Continued)

OTHER PUBLICATIONS

International Search Report dated Jul. 22, 2015, of the corresponding International Application PCT/EP2015/058884 filed Apr. 24, 2015.

*Primary Examiner* — Jessica Han
*Assistant Examiner* — Amal Patel
(74) *Attorney, Agent, or Firm* — Norton Rose Fulbright US LLP; Gerard Messina

(57) ABSTRACT

An antenna device having a settable directional characteristic and a method for operating an antenna device. The antenna device according to the present invention includes a feed signal provision unit, with the aid of which a first, second, third and fourth electrical feed signal may be provided, the electrical feed signals being coherent with one another and having phases relative to one another which are adapted to set the settable directional characteristic of the antenna device, the phases being adaptable with the aid of a feed signal adaptation unit; a plurality of antenna columns, each antenna column including a respective plurality of electrically connected antenna elements; the electrical feed signals being conductable for inducing the antenna elements
(Continued)

of the antenna columns to emit electromagnetic waves having the set directional characteristic.

4 Claims, 7 Drawing Sheets

(51) Int. Cl.
*H01Q 21/00* (2006.01)
*H01Q 21/06* (2006.01)

(56) References Cited

U.S. PATENT DOCUMENTS

| | | | | |
|---|---|---|---|---|
| 4,918,457 | A | 4/1990 | Gibson | |
| 2006/0033659 | A1* | 2/2006 | Strickland | H01Q 3/26 342/372 |
| 2009/0298421 | A1* | 12/2009 | Andersson | H04B 7/1555 455/11.1 |

FOREIGN PATENT DOCUMENTS

| | | | |
|---|---|---|---|
| JP | H05152825 | A | 6/1993 |
| JP | 2012049991 | A | 3/2012 |

* cited by examiner

ANTENNA DEVICE HAVING A SETTABLE DIRECTIONAL CHARACTERISTIC AND METHOD FOR OPERATING AN ANTENNA DEVICE

FIELD

The present invention relates to an antenna device having a settable directional characteristic, in particular to an antenna device having an antenna array of antenna elements situated in a matrix-like manner. The present invention furthermore relates to a method for operating an antenna device, in particular an antenna device according to the present invention.

BACKGROUND INFORMATION

There are many applications in which it is desirable or necessary to use an antenna to emit electromagnetic waves having a predefined directionality, i.e., having a predetermined directionality pattern, which is also referred to as a directional characteristic. It is advantageous in radar applications, for example, to emit electromagnetic waves having a certain directionality in order to be able to assign the electromagnetic waves reflected on an object and received to the position of the object.

In particular in radar applications, it is necessary to vary the direction in which the electromagnetic waves are emitted to be able to monitor a larger spatial area with the aid of the radar. Movable or swiveling antennas are used for this purpose, for example. Such antenna require a mechanical system which allows the antenna attached to the mechanical system to be suitably moved.

Furthermore, in conventional so-called phased array antennas, the antenna radiation pattern is electronically swivelable. Phased array antennas are made up of a plurality of antenna elements (array), which are supplied from a shared signal source. To swivel the antenna radiation pattern of such a phased array antenna, the individual transmitting elements of the phased array antenna are activated by a suitably phase-shifted signal. As a result, the individual emitted electromagnetic waves superimpose in the desired direction with a constructive interference and thus form, for example, a maximum or a minimum of radiated energy in the desired direction.

To individually set the phase and amplitude, such phased array antennas include a phase shifter and an attenuator for each of the transmitting elements. An antenna suitable for use in radar applications is described in German Patent Application No. DE 10 2010 040 793 A1, for example.

SUMMARY

The present invention provides an antenna device and a method.

The present invention provides an antenna device having a settable directional characteristic, including: a feed signal provision unit, with the aid of which a first, second, third and fourth electrical feed signal are providable, the electrical feed signals being coherent with one another and having phases relative to one another which are adapted to set the settable directional characteristic of the antenna device, the phases being adaptable with the aid of a feed signal adaptation unit; a first feed link having a first plurality of first branching units, the first electrical feed signal being feedable into the first feed link with the aid of a first feed terminal situated on a first end of the first feed link, and the second electrical feed signal being feedable into the first feed link with the aid of a second feed terminal situated on a second end of the first feed link; a second feed link having a second plurality of second branching units, the third electrical feed signal being feedable into the second feed link with the aid of a third feed terminal situated on a first end of the second feed link, and the fourth electrical feed signal being feedable into the second feed link with the aid of a fourth feed terminal situated on a second end of the first feed link; and a third plurality of antenna columns, each antenna column including a respective fourth plurality of electrically connected antenna elements, each of the antenna columns being electrically coupled between one of the first branching units of the first feed link and one of the second branching units of the second feed link, signals being conductable with the aid of each of the first branching units from the first feed link to the respective antenna column coupled to the first branching unit for inducing the antenna elements of the respective antenna column to emit electromagnetic waves having the set directional characteristic, and signals being conductable with the aid of each of the second branching units from the second feed link to the respective antenna column coupled to the second branching unit for inducing the antenna elements of the respective antenna column to emit electromagnetic waves having the set directional characteristic.

A feed link shall be understood to mean in particular a line which is used to feed electrical signals to antenna columns, it also being possible for the feed link to include one or multiple branchings and/or signal adaptation units, such as phase shifters or amplifiers. An arrangement of an element A "electrically between" two other elements B shall in particular be understood to mean that electrical signals, which run on the electrical path having the lowest loss, preferably along an electrical conductor, between the two other elements B, inevitably traverse element A.

Furthermore, a method for operating an antenna device is provided, in particular an antenna device according to the present invention, including the following steps: generating a first, second, third and fourth electrical signal, which are coherent with one another; providing a first, second, third and fourth electrical feed signal by adapting at least relative phases of the first, second, third and fourth electrical signal for setting the directional characteristic of the antenna device; applying the first feed signal to a first feed terminal of the antenna device; applying the second feed signal to a second feed terminal of the antenna device; applying the third feed signal to a third feed terminal of the antenna device; and applying the fourth feed signal to a fourth feed terminal of the antenna device.

In accordance with the present invention, the directional characteristic of an antenna device, which includes antenna elements situated in a matrix-like manner as individual radiating elements and which is fed four or more feed signals which are independent of one another and individually variable in terms of amplitude and/or phase at four or more different feed terminals, is two-dimensionally adaptable. This means that in particular an elevation and an azimuth of the main lobe of the directional characteristic is adaptable, and the main lobe is thus electronically swivelable in two dimensions.

According to the present invention, this is into account and the present invention provide an option for feeding, in particular simultaneously, four or more feed signals to an antenna device, which are adapted in such a way that antenna elements of the antenna device are excited by electrical signals phase shifted with respect to one another in such a way that the directional characteristic of the antenna device is formed as desired by superposition of the emitted electromagnetic waves.

Particularly advantageously, feed signals in the frequency range of 1 to 150 gigahertz, in particular from 20 to 100 gigahertz, are used. It is then possible to select the dimensions of the individual antenna elements in the millimeter range, for example. The antenna array is easy to implement in circuit board technology. Particularly preferably, feed signals in a frequency range of 70 to 85 gigahertz and essentially square antenna elements having an edge length in the order of magnitude of one millimeter are used. Advantageously, the antenna device is situated on a vehicle, in particular a road vehicle or a rail vehicle.

Advantageous specific embodiments and refinements are described herein with reference to the figures.

According to one preferred refinement, a signal adaptation unit, with the aid of which at least one parameter, in particular a phase and/or an amplitude, of an electrical signal propagating along the first feed link between the pair of the two branching units following one another along the first feed link, is situated between at least one, in particular each, pair of two branching units following one another along the first feed link. According to one further preferred refinement, a signal adaptation unit, with the aid of which at least one parameter, in particular a phase and/or an amplitude, of an electrical signal propagating along the second feed link between the pair of the two branching units following one another along the second feed link, is situated between at least one, in particular each, pair of two branching units following one another along the second feed link. In this way, a particularly advantageous distribution of the fed electrical feed signals for attaining the desired directional characteristic may take place.

According to one further preferred refinement, a signal adaptation unit, with the aid of which at least one parameter, in particular a phase and/or an amplitude, of an electrical signal propagating between the branching unit and the antenna column, is electrically situated between at least one, in particular each, of the branching units and a respective antenna column coupled into the at least one branching unit.

According to one further preferred refinement, at least one signal adaptation unit includes a phase shifter. The at least one parameter of the electrical signal adaptable with the aid of the signal adaptation unit is thus a phase of the electrical signal. Preferably, each of the signal adaptation units is designed as a phase shifter. The signal adaptation unit is advantageously designed as an angled or curved deviation of a strip conductor from a track of the strip conductor on a shortest path between two branching units or between one branching unit and one antenna column. In this way, phase shifters may be implemented with particularly low technical complexity.

According to one further preferred refinement, at least one, preferably all, of the branching units is/are designed as simple line nodes, in particular as three-line nodes.

According to one further preferred refinement, at least the first and second feed links, the first and second branching units, the antenna columns, and the antenna elements are designed in microstrip technology. Preferably, the entire antenna array is designed in microstrip technology. In this way, the antenna array is producible with particularly low technical complexity.

According to one preferred refinement of the method according to the present invention, the first, second, third and fourth feed terminals are created at least partially simultaneously. In this way, particularly precise setting of the directional characteristic is possible by superimposing the signals exciting the antenna elements, which are based on the feed signals.

According to one further preferred refinement, the method includes the following step: adapting the phase and/or the amplitude of at least one of the first, second, third and fourth feed signals to adapt the set directional characteristic. In this way, for example, electronic beam scanning may be achieved.

BRIEF DESCRIPTION OF THE DRAWINGS

The present invention is described in greater detail below based on the exemplary embodiments shown in the figures.

In all figures, identical or functionally equivalent elements and devices were denoted by the same reference numerals, unless indicated otherwise.

DETAILED DESCRIPTION OF EXAMPLE EMBODIMENTS

Figure 1:
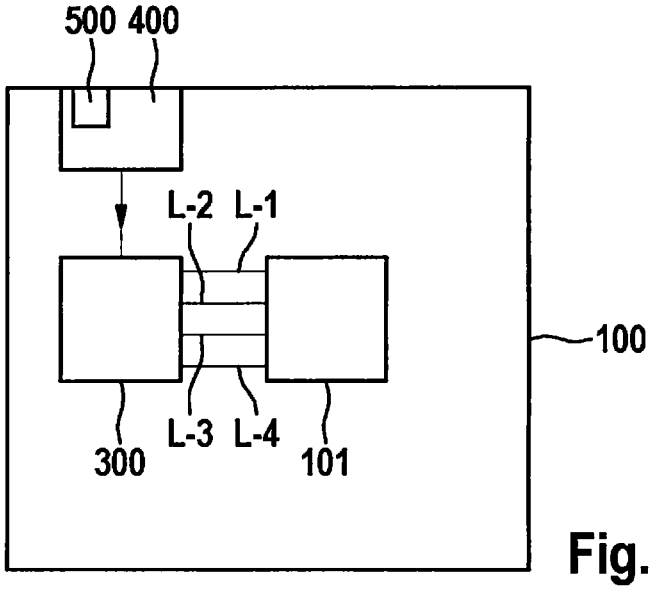
FIG. 1 shows a schematic block diagram of an antenna device 100 according to a first specific embodiment of the present invention.

FIG. 1 shows a schematic block diagram of an antenna device 100 according to a first specific embodiment of the present invention. According to the first specific embodiment, antenna device 100 includes a feed signal provision unit 300, which is electrically connected to an antenna array of antenna device 100 via first through fourth, i-th for short, lines L-1, L2, L3, L4, L-i for short. Furthermore, antenna device 100 according to the first specific embodiment includes a control unit 400 for controlling controllable elements of feed signal provision unit 300. The desired directional characteristic of the antenna device to be set may be input, automatically or by a user, via an interface 500 of control unit 400.

Figure 2:
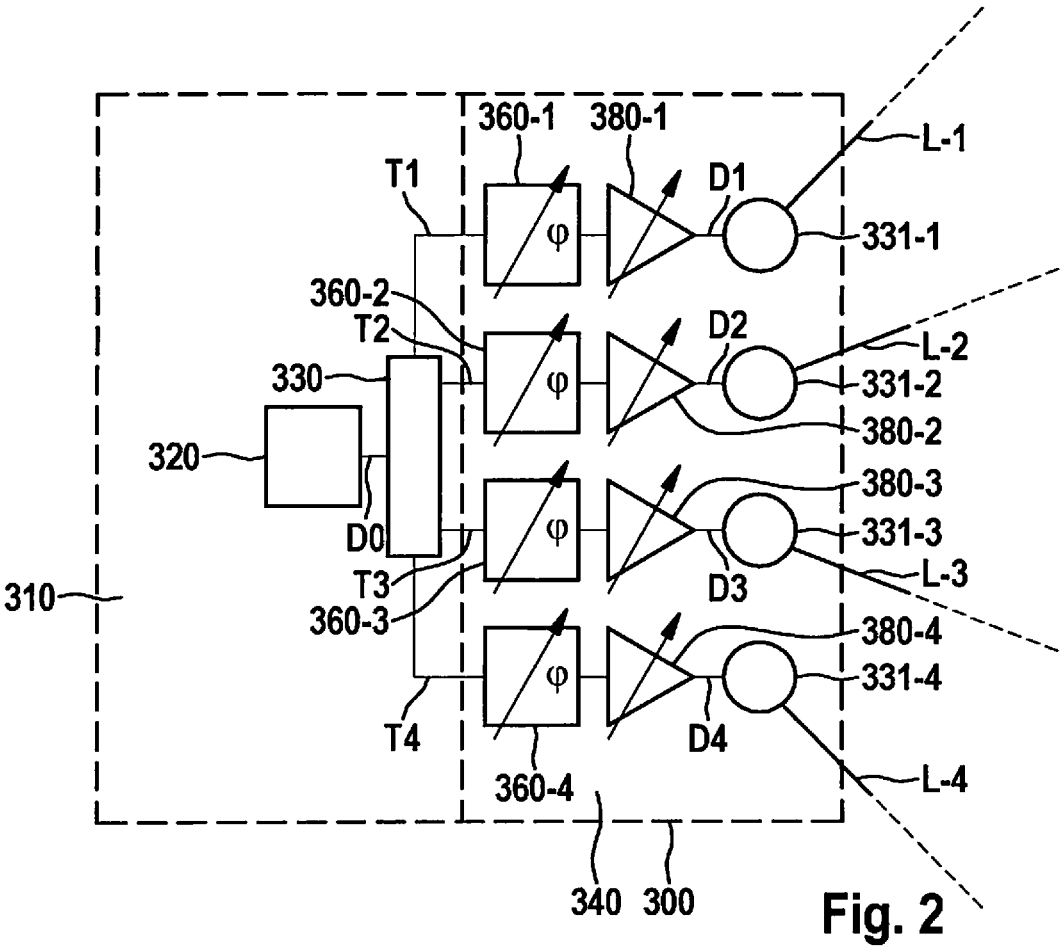
FIG. 2 shows a schematic block diagram of feed signal provision unit 300 of antenna device 100 according to the first specific embodiment of the present invention.

FIG. 2 shows a schematic block diagram of feed signal provision unit 300 of antenna device 100 according to the first specific embodiment of the present invention. According to the first specific embodiment, feed signal provision unit 300 includes a feed signal generation unit 310 and a feed signal adaptation unit 340. Based on the desired directional characteristic to be set, control unit 400 controls feed signal provision unit 300, in particular feed signal adaptation unit 340.

Feed signal generation unit 310 includes a signal generator 370, with the aid of which a coherent electrical original signal D0 having an original phase and an original amplitude may be generated. Original signal D0 is transmitted to a division unit 320, which divides the original signal into a first through fourth subsignal T1, T2, T3, T4, T-i for short, and transmits each of these to a first through fourth phase adaptation unit 360-1, 360-2, 360-3, 360-4, **360-*i* for short, controllable with the aid of control unit 400. According to the first specific embodiment, division unit 320 is a quadruple line splitter, i.e., a five-line node, with the aid of which original signal D0** is divided into the four subsignals T-i, each having a power of one quarter of an original signal power.

The i-th controllable phase adaptation unit **360-*i***, where i is from one through four, is designed to shift an i-th phase of i-th subsignal T-i by an i-th phase shift value Δφ-i relative to the original phase of the original signal. An "i-th phase" or an "i-th amplitude of i-th subsignal T-i" shall only be understood to mean a designation, not, for example, that the i-th subsignal has multiple phases or amplitudes from a first to an i-th.

For example, third controllable Δ phase adaptation unit 360-3 is designed to shift the third phase of third subsignal T-3 by a third phase shift value Δφ-3 relative to the original phase of the original signal. One or multiple of the i-th phase shift values Δφ-i may also be vanishing, i.e., equal to zero, so that corresponding i-th subsignal T-i may remain in-phase with the original signal. According to the first specific embodiment, controllable phase adaptation units **360-*i*** are designed as phase shifters.

The particular i-th controllable phase adaptation unit **360-*i* transmits the i-th subsignal with the i-th phase shifted by i-th phase shift value Δφ-i to a respective i-th amplitude adaptation unit 380-*i*, with the aid of which a particular i-th amplitude of the i-th subsignal is amplifiable or reducible by a particular i-th amplification value dB-i. I-th amplification value dB-i may also be one, so that essentially no amplification or reduction of the i-th amplitude takes place. The particular i-th subsignal having the i-th phase shifted by i-th phase shift value Δφ-i and the i-th amplitude amplified or reduced by i-th amplification value dB-i is transmitted as the i-th, i.e., as the first, second, third or fourth, feed signal D1, D2, D3, D4 to a particular i-th output terminal 331-*i* of feed signal provision unit 300. For example, the third subsignal having the phase shifted by third phase shift value Δφ-3 and the third amplitude amplified by third amplification value dB-3 is transmitted as third feed signal D3 to third output terminal 331-3**.

Figure 3A:
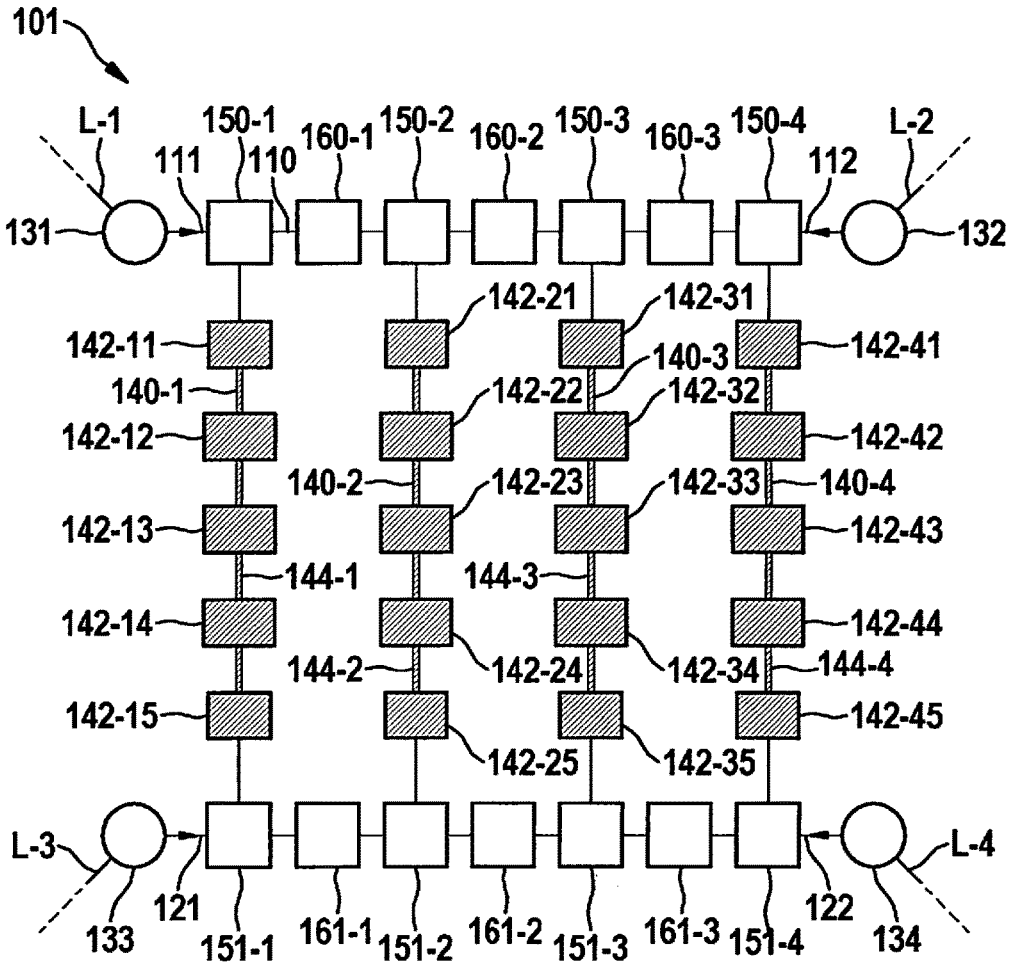
FIG. 3A shows a schematic block diagram of an antenna array 101 of antenna device 100 according to the first specific embodiment of the present invention.

FIG. 3A shows a schematic block diagram of an antenna array 101 of antenna device 100 according to the first specific embodiment of the present invention.

Figure 3B:
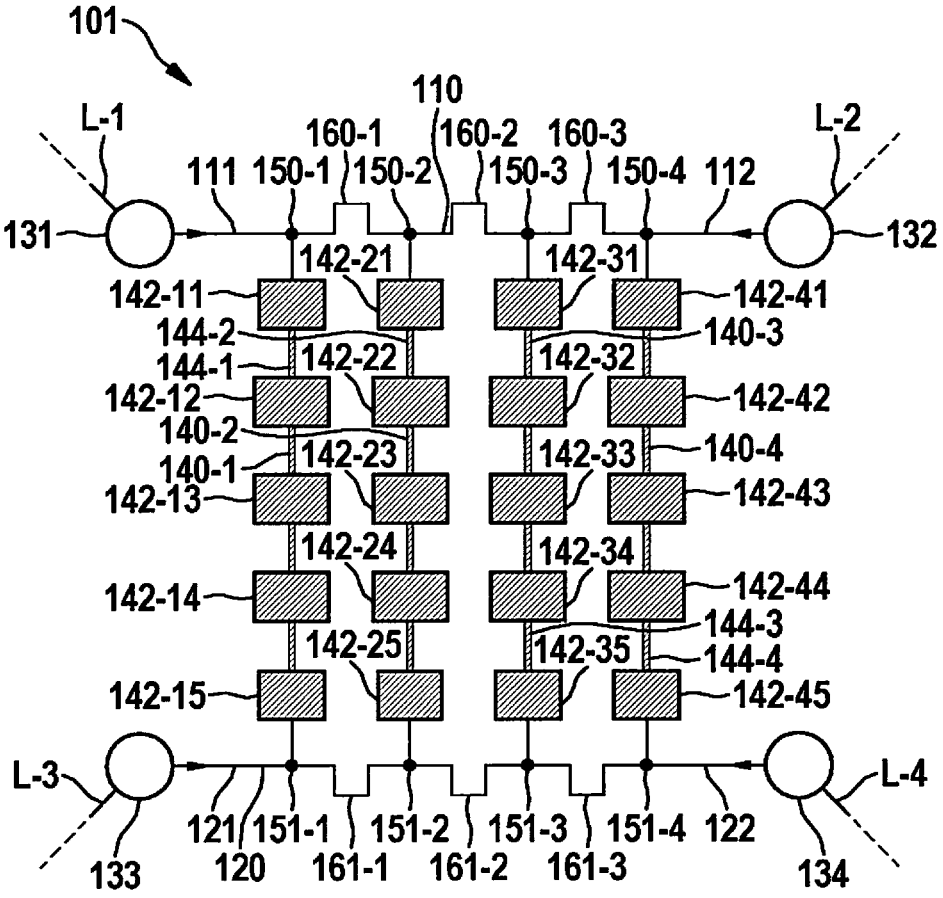
FIG. 3B shows a schematic top view onto antenna array 101 of antenna device 100 according to the first specific embodiment of the present invention.

FIG. 3B shows a schematic top view onto the antenna array 101 of antenna device 100 according to the first specific embodiment of the present invention. According to the first specific embodiment, antenna array 101 is designed in microstrip technology having patch antennas.

According to the first specific embodiment, the particular i-th output terminal **331-*i* is electrically connected via electrical lines, in particular directly, via i-th line L-i to a particular i-th feed terminal 131, 132, 133, 134. For example, third output terminal 331-3 is electrically connected via third line L-3 to third feed terminal 133**.

Antenna array 101 of antenna device 100 includes a first, essentially linear feed link 110 and a second, essentially linear feed link 120. First feed signal D1 may be fed into first feed link 110 on a first of two ends of first feed link 110 with the aid of first feed point 131, and second feed signal D2 may be fed at a second of the two ends of first feed link 110 with the aid of second feed point 132. Third feed signal D3 may be fed into second feed link 120 on a first of two ends of second feed link 120 with the aid of third feed point 133, and fourth feed signal D4 may be fed at a second of the two ends of second feed link 120 with the aid of fourth feed point 134.

First feed link 110 includes a first plurality of first branching units **150-*i*, which are situated spaced apart from one another along first feed link 110. According to the first specific embodiment, the first plurality is four. First branching units 150-1, 150-2, 150-3, 150-4 are each designed as simple, T-shaped three-line nodes, as shown in FIG. 3**B.

Second feed link 120 includes a second plurality of second branching units **151-*i*, which are situated spaced apart from one another along second feed link 120. According to the first specific embodiment, the second plurality is four. Second branching units 151-1, 151-2, 151-3, 151-4 are each designed as simple, T-shaped three-line nodes, as shown in FIG. 3B. The particular division properties of first and second branching units 150-*i*, 151-*i*** may be set, for example, by impedance properties and/or differently wide line widths of the three lines converging at the three-line nodes.

One of a third plurality of antenna columns **140-*i*, here of four antenna columns 140-*i*, is electrically coupled in each case between a first branching unit 150-*i* and a second branching unit 151-*i*. Each of antenna columns 140-*i* includes a fourth plurality of antenna elements 142-*ij*, which according to the first specific embodiment are designed as patch antennas. According to the first specific embodiment, furthermore all fourth pluralities are identical and have the value five. The patch antennas may be designed in differing sizes, for example having relatively larger surface areas in the vicinity of first and second feed links 110, 120 and having relatively smaller surface areas in the vicinity of a center between first and second feed links 110, 120**.

Antenna columns **140-*i* are essentially in parallel to one another. To form antenna columns 140-*i*, antenna elements 142-*ij* are each electrically connected to one another within a particular antenna column 140-*i* via a linear line 144-*i* designed in microstrip technology. Linear first and second power links 110, 120 are also in parallel to one another and are advantageously situated perpendicularly on antenna columns 140-*i***.

A first phase shifter **160-*i*, which shifts a phase of an electrical signal propagating between the respective two first branching units 150-*i*, is situated electrically between respective two first branching units 150-*i* following one another along first feed link 110. A second phase shifter 161-*i*, which shifts a phase of an electrical signal propagating between the respective two second branching units 151-*i*, is situated electrically between respective two second branching units 151-*i* following one another along second feed link 120**.

As shown in FIG. 3B, according to the first specific embodiment, first and second phase shifters **160-*i*, 161-*i* are each designed as an angular, rectangular pulse-shaped deviation of an electrical strip conductor between the respective first or second branching units 150-*i*, 151-*i* from a linear track of the strip conductor on the shortest path between the respective consecutive first or second branching units 150-*i*, 151-*i*. The rectangular pulse-shaped deviation always takes place in a direction facing away from antenna columns 142-*ij***.

According to the first specific embodiment, dimensions of phase shifters 160-*i*, 161-*i* and of feed links 110, 120 are selected in such a way that the propagation time of at least one feed signal T1, T2, T3, T4, preferably of all feed signals T1, T2, T3, T4, fed into a feed link 110, 120 between two branching units 150-*i*, 150-*i* following one another along corresponding feed link 110, 120 is always increased by the same propagation time difference. For example, the dimensions of phase shifters 160-*i*, 161-*i* and of feed links 110, 120 are selected in such a way that first feed signal T1 fed at first feed point 131 impinges on first branching unit 150-1 at a point in time t0, impinges along first feed link 110 on second branching unit 150-2 at a point in time t0+1Δt, impinges along first feed link 110 on third branching unit 150-3 at a point in time t0+2Δt, and impinges along first feed link 110 on fourth branching unit 150-4 at a point in time t0+3Δt.

By simultaneously feeding two, three or four of the first through fourth feed signals T1, T2, T3, T4, each having the adapted i-th phases and/or adapted i-th amplitudes, it is thus possible to deliberately control with which signals at which points in time which antenna elements 142-*ij* are induced to emit electromagnetic radiation, whereby an instantaneous directional characteristic of the antenna device corresponds to the set directional characteristic. By further adapting the i-th phases and/or i-th amplitudes of the first through fourth feed signals T1, T2, T3, T4, electronic beam scanning may be carried out.

Figure 4A:
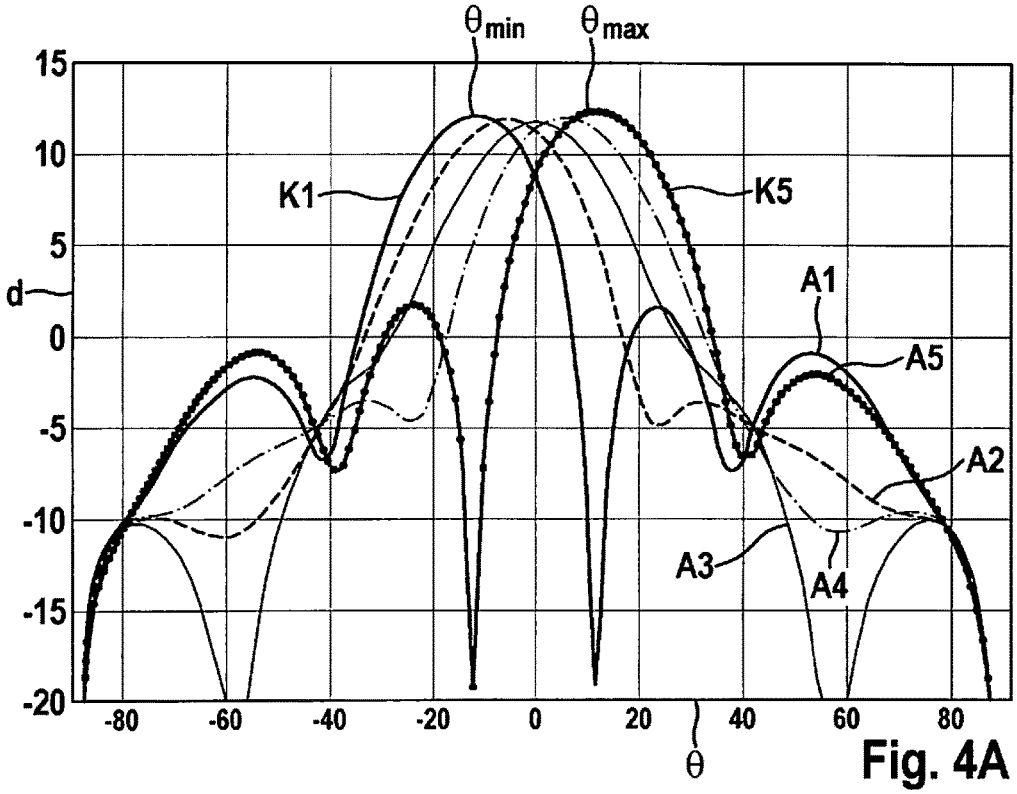
FIG. 4A and FIG. 4B show exemplary set directional characteristics of antenna device 100 according to the first specific embodiment.
Figure 4B:
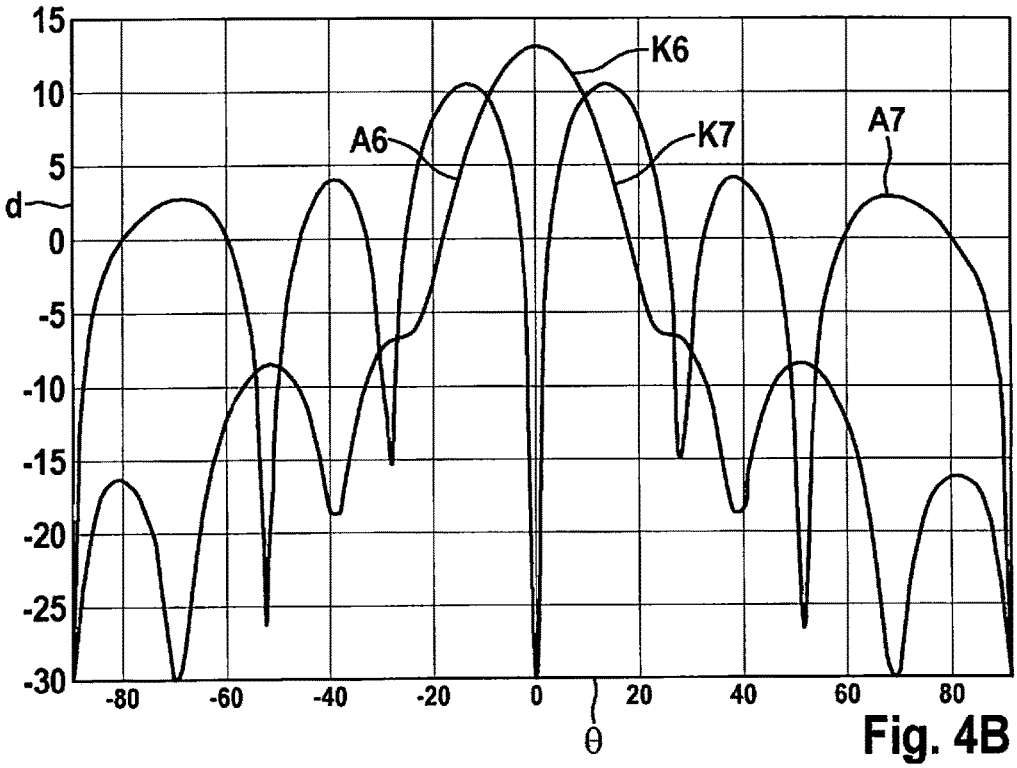

FIGS. 4A and 4B show exemplary set directional characteristics of antenna device 100 according to the first specific embodiment.

In an arrangement of the antenna array 101 in a plane perpendicular to the ground, with feed links 110, 120 in parallel to the ground, such as in a vehicle, elevation angles and azimuth angles θ of a main lobe of the directional characteristic may be set. To form a minimal azimuth angle Θmin, for example, only first and second feed signals T1, T2 may be fed, and to form a maximal azimuth angle Θmax, for example, only third and fourth feed signals T3, T4 may be fed. To form a minimal elevation angle, for example, only first and third feed signals T1, T3 may be fed, and to form a maximal elevation angle, for example, only second and fourth feed signals T2, T4 may be fed.

FIG. 4A shows a directivity d in decibels as a function of azimuth angle Θ in degrees according to different exemplary directional characteristics A1, A2, A3, A4, A5, including a first directional characteristic A1, whose main lobe K1 has the azimuth angle Θ having the minimal azimuth angle Θmin, and a fifth directional characteristic A5, whose main lobe K5 has the azimuth angle Θ having the maximal minimal azimuth angle Θmax.

FIG. 4B shows directivity d in decibels as a function of azimuth angle Θ in degrees according to two further exemplary directional characteristics A6, A7. Sixth directional characteristic A6 has a maximal main lobe K6 at Θ=0 degrees, for example in that feed signals T1, T2, T3, T4 are adapted for positive interference at Θ=0. Seventh directional characteristic A7 has a minimal, vanishing main lobe K7 at Θ=0 degrees, for example in that feed signals T1, T2, T3, T4 are designed or adapted for negative interference at Θ=0. To this end, third feed signal T3 may advantageously be designed or adapted as an inverted, i.e., having a reversed sign, first feed signal T1, and second feed signal T2 may be designed or adapted as inverted fourth feed signal T4.

For a directional characteristic having a directivity of essentially zero at zero degrees of the elevation angle, shown in FIG. 4A with a directivity of −30 decibels, third feed signal T3 may advantageously be designed or adapted as inverted fourth feed signal T4, and second feed signal T2 may be designed or adapted as inverted first feed signal T1. The directional characteristic may thus be guidable around an object situated directly in front of the antenna, for example.

Figure 5A:
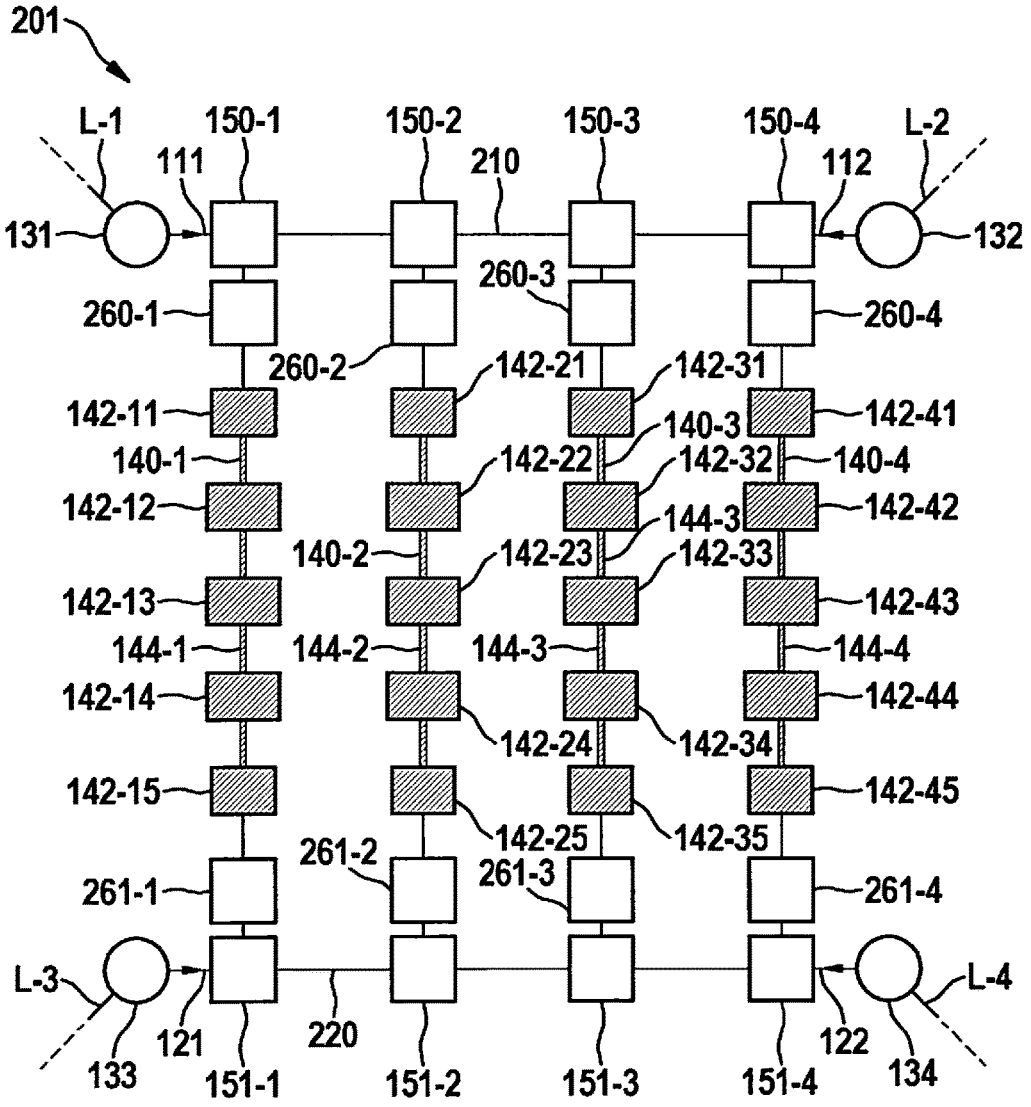
FIG. 5A shows a schematic block diagram of an antenna array 201 of an antenna device 200 according to a second specific embodiment of the present invention.

FIG. 5A shows a schematic block diagram of an antenna array 201 of an antenna device 200 according to a second specific embodiment of the present invention. Antenna device 200 according to the second specific embodiment is a variant of antenna device 100 according to the first specific embodiment, from which it differs in that antenna array 201 according to the second specific embodiment differs from antenna array 101 according to the first specific embodiment.

Figure 5B:
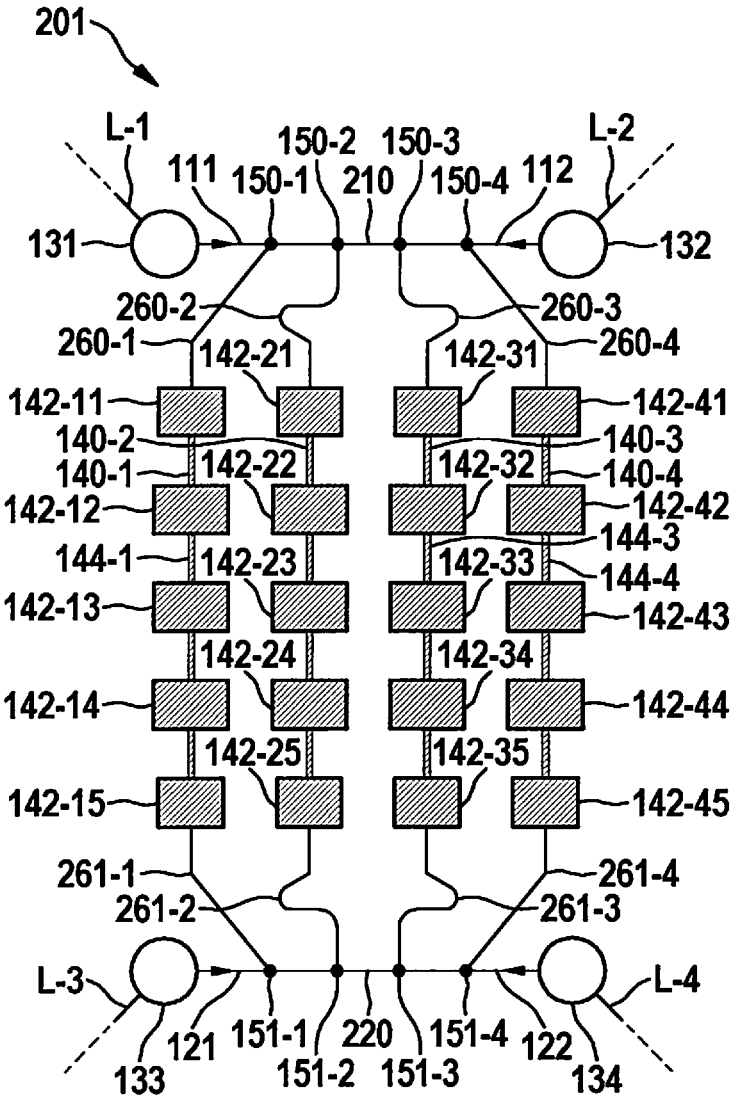
FIG. 5B shows a schematic top view onto antenna array 201 of antenna device 200 according to the second specific embodiment of the present invention.

FIG. 5B shows a schematic top view onto antenna array 201 of antenna device 200 according to the second specific embodiment of the present invention. Antenna array 201 according to the second specific embodiment is a variant of antenna array 101 according to the first specific embodiment and differs from the same only in the design and arrangement of the phase shifters. Antenna array 201, as shown in FIG. 5A, has rectilinear electrical connections, established in microstrip technology and guided on the shortest path in each case between two first or second branching units 150-*i*, 151-*i* following one another along first or second feed link 210, 220.

In further contrast to antenna array 101, antenna array 201, as shown in FIG. 5A, includes a first phase shifter 260-*i* electrically between each first branching unit 150-*i* and a respective antenna column 140-*i* coupled to first feed link 210 directly via first branching unit 150-*i*. Furthermore, antenna array 201 includes a second phase shifter 261-*i* electrically between each of second branching units 151-*i* and a respective antenna column 140-*i* coupled to second feed link 220 directly via second branching unit 151-*i*.

As shown in FIG. 5B, according to the second specific embodiment, first and second phase shifters 260-*i*, 261-*i* are each designed as an angular or curved deviation of an electrical strip conductor from a linear track of the strip conductor on a shortest path between respective first or second branching units 150-*i*, 151-*i* and respective antenna column 140-*i*.

Figure 6:
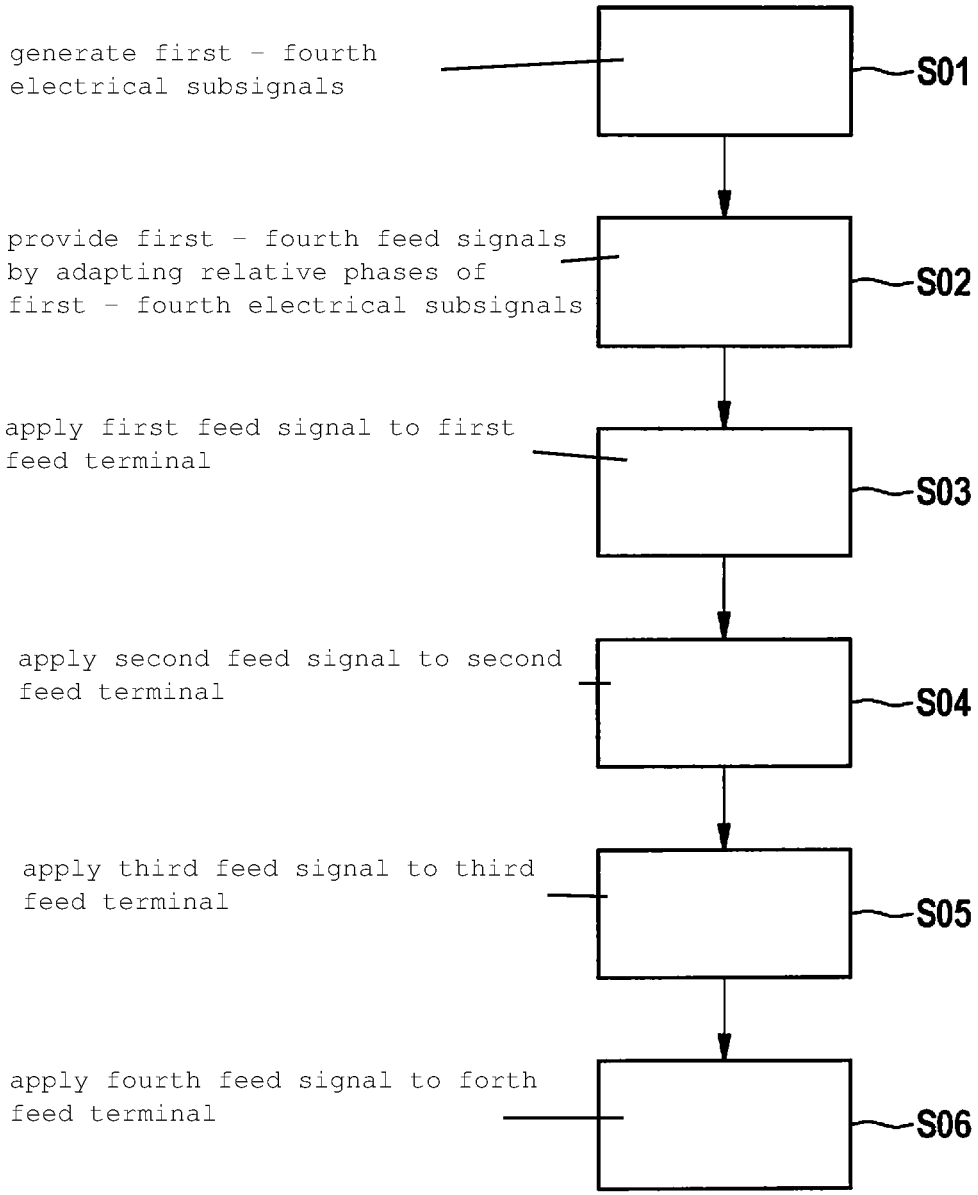
FIG. 6 shows a schematic flow chart to explain a method for operating an antenna device according to a third specific embodiment of the present invention.

FIG. 6 shows a schematic flow chart to explain a method for operating an antenna device according to a third specific embodiment of the present invention. The method according to the third specific embodiment is in particular suitable for operating antenna device 100, 200 according to the first or second specific embodiment of the present invention. For details about the method, reference is also made to the explanations to the preceding FIGS. 1 through 5. The method according to the third specific embodiment may advantageously be adapted in such a way that it may also be used to operate the different described variants and advantageous specific embodiments of antenna device 100, 200 according to the present invention.

In a step S01, first, second, third and fourth electrical subsignals T1, T2, T3, T4 are generated, as is described in greater detail above based on FIG. 2.

In a step S02, first, second, third and fourth electrical feed signals D1, D2, D3, D4 are provided by adapting at least relative phases of first, second, third and fourth electrical subsignals T1, T2, T3, T4 for setting the directional characteristic of antenna device 100; 200.

To induce antenna elements 142-*ij* to emit electromagnetic radiation having the set directional characteristic, in a step S03 first feed signal D1 is applied to first feed terminal 131 of antenna device 100; 200; in a step S04 second feed signal D2 is applied to second feed terminal 132 of antenna device 100; 200; in a step S05 third feed signal D3 is applied to third feed terminal 133 of antenna device 100; 200; and in a step S06 fourth feed signal D1 is applied to fourth feed terminal 134 of antenna device 100; 200. Application S03, S04, S05, S06 may take place repeatedly, permanently and/or always or at least partially simultaneously.

In a step S07, the phase and/or the amplitude of at least one of first, second, third and fourth feed signals D1, D2, D3, D4 is adapted for adapting the set directional characteristic. This may take place, for example, by feed signal adaptation unit 340, controlled by control unit 400.

Although the present invention has been described above based on preferred exemplary embodiments, it is not limited thereto, but is modifiable in a variety of ways. The present invention may in particular be changed or modified in multiple ways without departing from the core of the present invention.

For example, the antenna columns may include fourth pluralities of antenna elements which are each different. The antenna elements may also have differing dimensions within an antenna column, for example they may tend to be smaller toward the edge of a matrix-shaped antenna array than toward the center.

What is claimed is:

1. An antenna device having a settable directional characteristic, comprising:

a feed signal provision unit with the aid of which a first, second, third and fourth electrical feed signal is providable, the electrical feed signals being coherent with one another and having phases relative to one another which are adapted to set the settable directional characteristic of the antenna device, the phases being adaptable with the aid of a feed signal adaptation unit;

a first feed link having a first plurality of first branching units, the first electrical feed signal being feedable into the first feed link with the aid of a first feed terminal situated on a first end of the first feed link, and the second electrical feed signal being feedable into the first feed link with the aid of a second feed terminal situated on a second end of the first feed link;

a second feed link having a second plurality of second branching units, the third electrical feed signal being feedable into the second feed link with the aid of a third feed terminal on a first end of the second feed link, and the fourth electrical feed signal being feedable into the second feed link with the aid of a fourth feed terminal situated on a second end of the first feed link; and a plurality of antenna columns, each of the antenna column including a respective plurality of electrically connected antenna elements, each of the antenna columns being electrically coupled between one of the first branching units of the first feed link and one of the second branching units of the second feed link;

wherein signals from the first feed link are conductable with the aid of each of the first branching units to the particular antenna column coupled to the first branching unit to induce the antenna elements of the particular antenna column to emit electromagnetic waves having the set directional characteristic;

wherein signals from the second feed link are conductable with the aid of each of the second branching units to the particular antenna column coupled to the second branching unit to induce the antenna elements of the particular antenna column to emit electromagnetic waves having the set directional characteristic;

wherein between each first branching unit and a respective one of the antenna columns and between each second branching unit and a respective one of the antenna columns a respective signal adaptation unit is electrically situated, each signal adaptation unit adapting one of:

at least one of a phase and an amplitude of an electrical signal propagating between the corresponding first branching unit and the respective antenna column, and at least one of a phase and an amplitude of an electrical signal propagating between the corresponding second branching unit and the respective antenna column;

wherein at least one of the signal adaptation units includes a phase shifter, and the at least one of the phase and amplitude that is adapted by the signal adaptation unit is the phase of the electrical signal; and wherein at least one of the signal adaptation units is designed as an angular or curved deviation of a strip conductor from a track of the strip conductor on a shortest path between two branching units or between a branching unit and an antenna column.

2. The device as recited in claim 1, wherein at least one of:

i) each signal adaptation unit is disposed between a different respective pair of the first branching units following one another along the first feed link, each signal adaptation unit adapting at least one of a phase and an amplitude of an electrical signal propagating along the first feed link between the respective pair of the first branching units following one another along the first feed link; and ii) each signal adaptation unit is disposed between a different respective pair of the second branching units following one another along the second feed link, each signal adaptation unit adapting at least one of a phase and an amplitude of an electrical signal propagating along the second feed link between the respective pair of the second branching units following one another along the second feed link.

3. The device as recited in claim 1, wherein at least one of the branching units is a simple line node.

4. The device as recited in claim 1, wherein at least the first and second feed links, the first and second branching units, the antenna columns and the antenna elements are designed in microstrip technology.

* * * * *